US012797678B2

(12) United States Patent
Fournier et al.

(10) Patent No.: US 12,797,678 B2
(45) Date of Patent: Nov. 17, 2026

(54) DEVICE FOR IMPLEMENTING A TECHNIQUE OF MENTAL REPRESENTATION FOR REHABILITATION OF LOWER LIMBS

(71) Applicant: DESSINTEY, Saint-Jean-Bonnefonds (FR)

(72) Inventors: Nicolas Fournier, Saint-Victor-sur-Loire (FR); Davy Luneau, Beauzac (FR); Emmanuel Lagnien, Saint-Peray (FR)

(73) Assignee: DESSINTEY, Saint-Jean-Bonnefonds (FR)

( * ) Notice: Subject to any disclaimer, the term of this patent is extended or adjusted under 35 U.S.C. 154(b) by 293 days.

(21) Appl. No.: 18/697,185

(22) PCT Filed: Aug. 30, 2022

(86) PCT No.: PCT/FR2022/051624
§ 371 (c)(1),
(2) Date: Mar. 29, 2024

(87) PCT Pub. No.: WO2023/052695
PCT Pub. Date: Apr. 6, 2023

(65) Prior Publication Data

US 2025/0001243 A1 Jan. 2, 2025

(30) Foreign Application Priority Data

Sep. 29, 2021 (FR) ..... 2110263

(51) Int. Cl.
*A63B 22/00* (2006.01)
*A63B 71/06* (2006.01)

(52) U.S. Cl.
CPC ..... *A63B 22/00* (2013.01); *A63B 71/0619* (2013.01); *A63B 2022/0094* (2013.01);
(Continued)

(58) Field of Classification Search
CPC .... A63B 22/00; A63B 2220/806; G09B 23/28
(Continued)

(56) References Cited

U.S. PATENT DOCUMENTS 9,028,258 B2 * 5/2015 Burdea ..... A61B 5/375 482/50
9,522,316 B2 * 12/2016 Burdea ..... A63B 24/0075
(Continued)

FOREIGN PATENT DOCUMENTS

CN 108392816 A * 8/2018 ..... A63B 71/0622
KR 101196960 11/2012
KR 101698244 2/2017

OTHER PUBLICATIONS

Anonymous. "Intensive Visual Simulation—A Unique Technology 1-12 Dedicated to Motor Planning and Central Control of Movement" Juin, Jun. 30, 2020 (Jun. 30, 2020).
(Continued)

*Primary Examiner* — Kurt Fernstrom
(74) *Attorney, Agent, or Firm* — IPSILON USA, LLP

(57) ABSTRACT

A device for implementing a mental representation technique for the rehabilitation of at least one lower limb, in front of which a patient is intended to be positioned, includes a central camera arranged to film the lower limb from a central viewpoint and a central display screen arranged to hide the patient's direct view of the lower limb, and intended to display the viewpoint filmed by the central camera. The device also includes at least one lateral camera arranged to film the lower limb from a lateral perspective, and a lateral display screen intended to display the viewpoint filmed by the lateral camera.

13 Claims, 6 Drawing Sheets

(52) U.S. Cl.
CPC ..... *A63B 2071/0647* (2013.01); *A63B 2071/0658* (2013.01); *A63B 2220/806* (2013.01)

(58) Field of Classification Search
USPC ..... 434/255, 257, 262
See application file for complete search history.

(56) References Cited

U.S. PATENT DOCUMENTS

| | | | | |
|---|---|---|---|---|
| 10,112,066 | B2 * | 10/2018 | Heathfield | A63B 21/4035 |
| 10,993,623 | B2 * | 5/2021 | Fournier | A61B 5/0079 |
| 11,673,042 | B2 * | 6/2023 | Macri | A63F 13/212 463/31 |
| 12,083,382 | B2 * | 9/2024 | Roberts | A63B 21/00 |
| 2008/0306572 | A1 * | 12/2008 | Osada | A61M 21/00 607/54 |
| 2014/0172166 | A1 * | 6/2014 | Kim | A61H 1/0244 601/5 |
| 2015/0313793 | A1 * | 11/2015 | Lee | A61F 2/583 434/257 |
| 2020/0214572 | A1 | 7/2020 | Dessintey | |

OTHER PUBLICATIONS

International Search Report dated Oct. 26, 2022.

* cited by examiner

[Fig. 1]
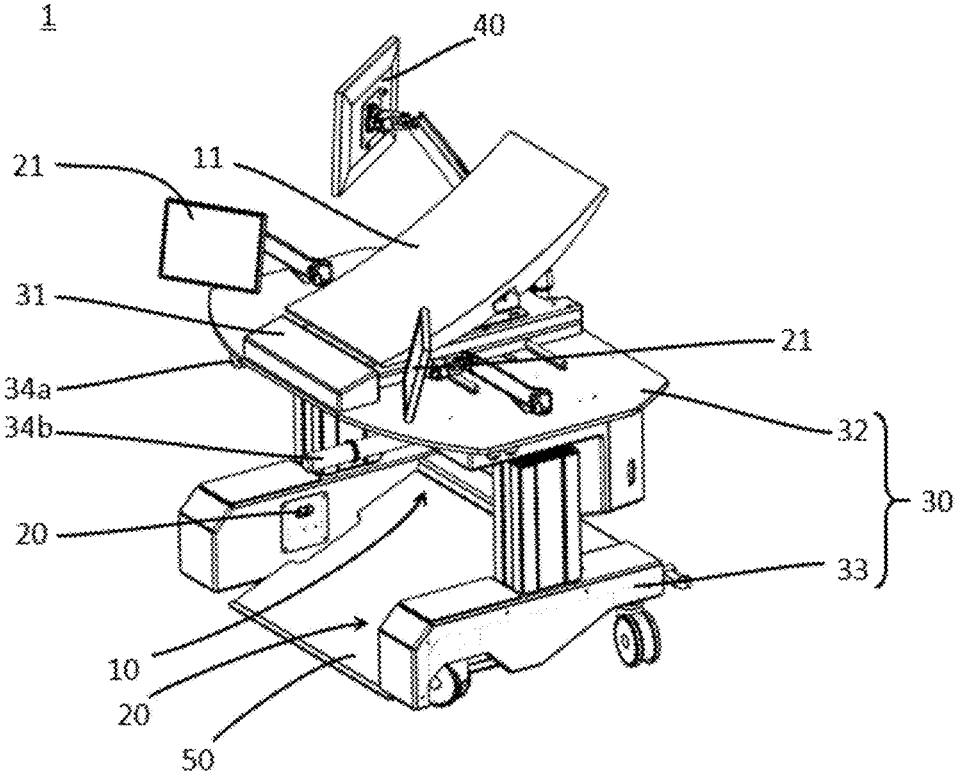

[Fig. 2]
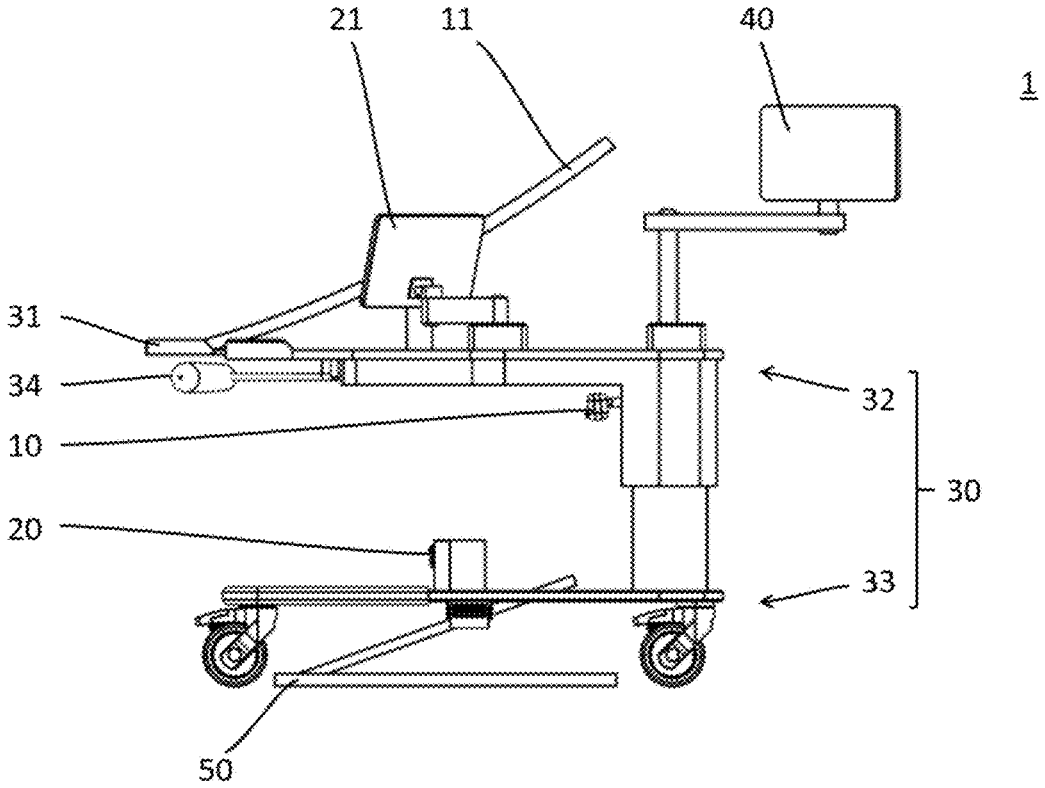
[Fig. 3]
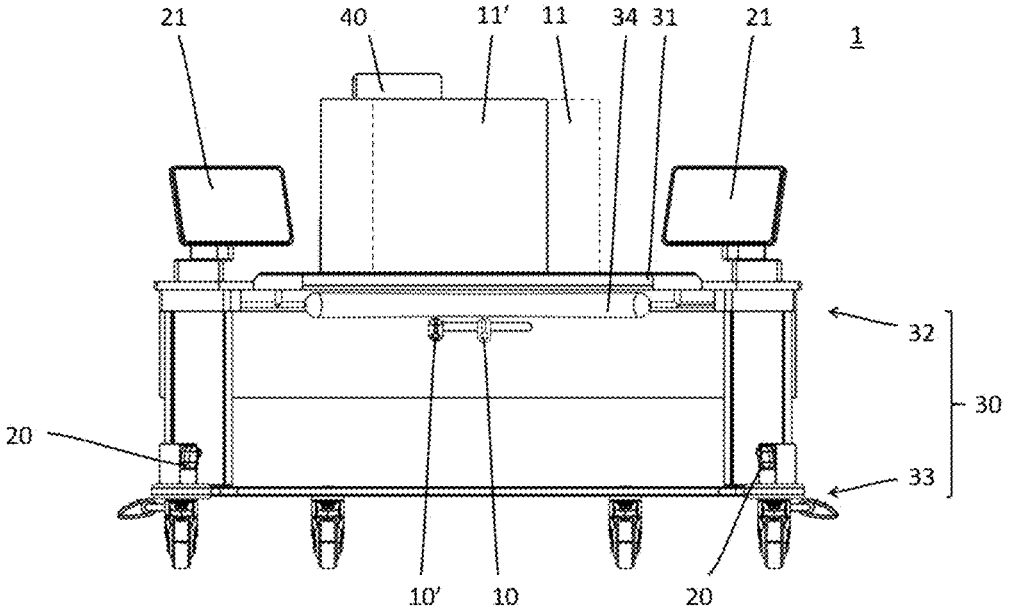

[Fig. 4]
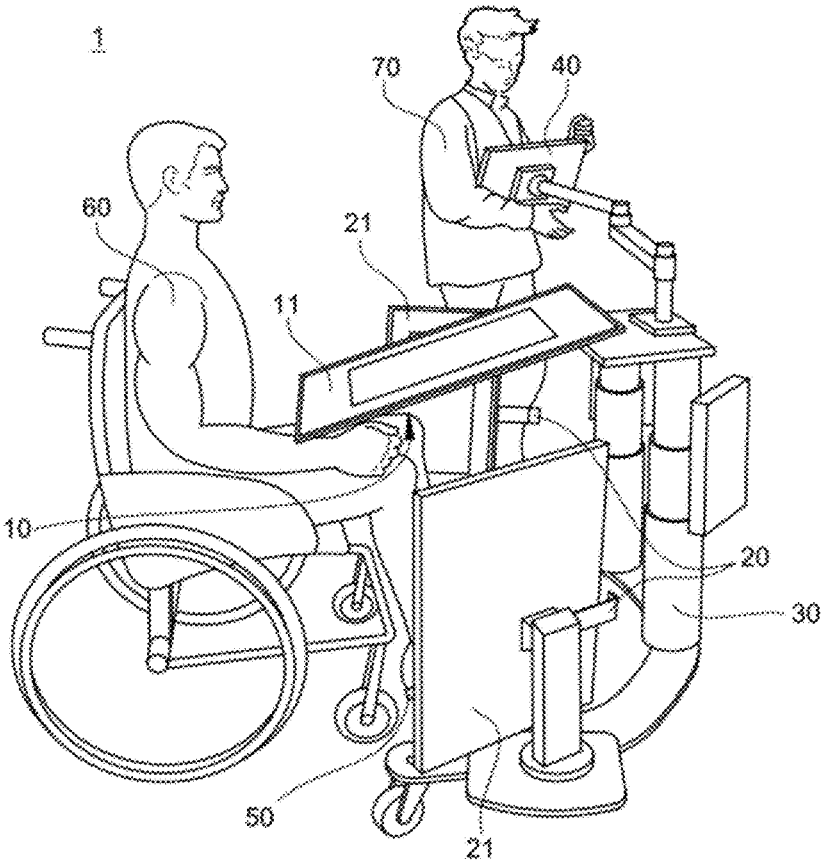

[Fig. 5]
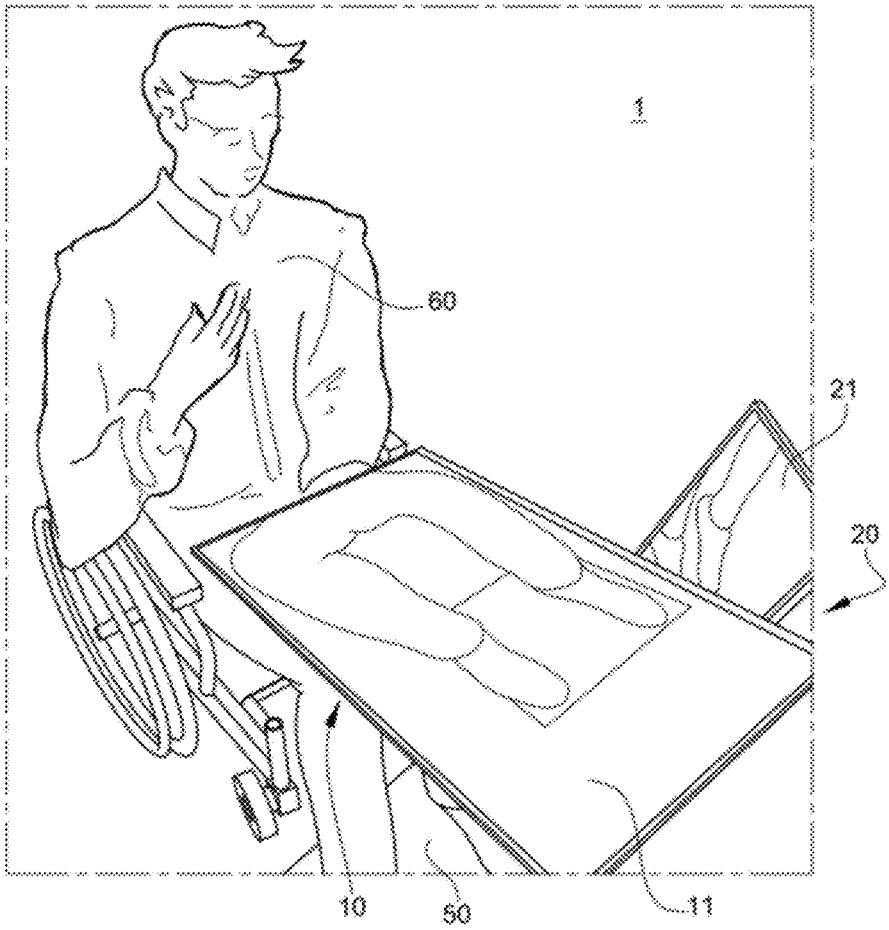
[Fig. 6]
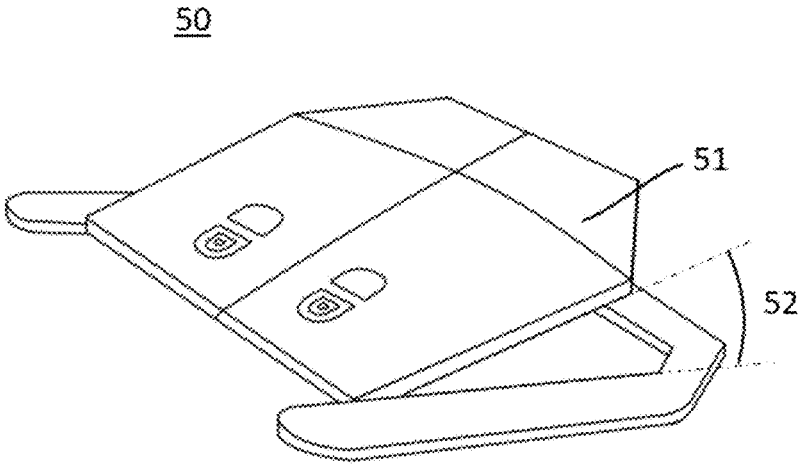

[Fig. 7]
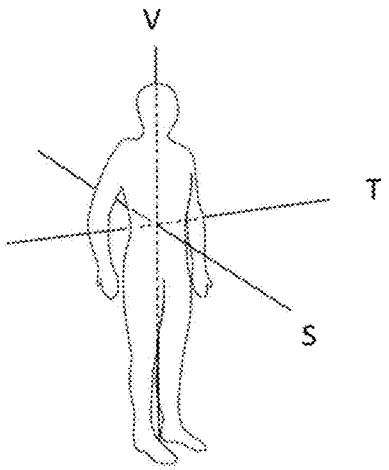
[Fig. 8]
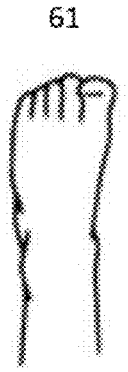

[Fig 9]
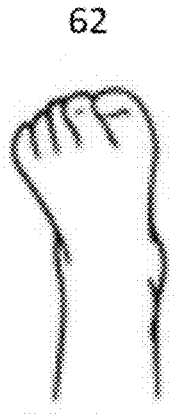
[Fig. 10]
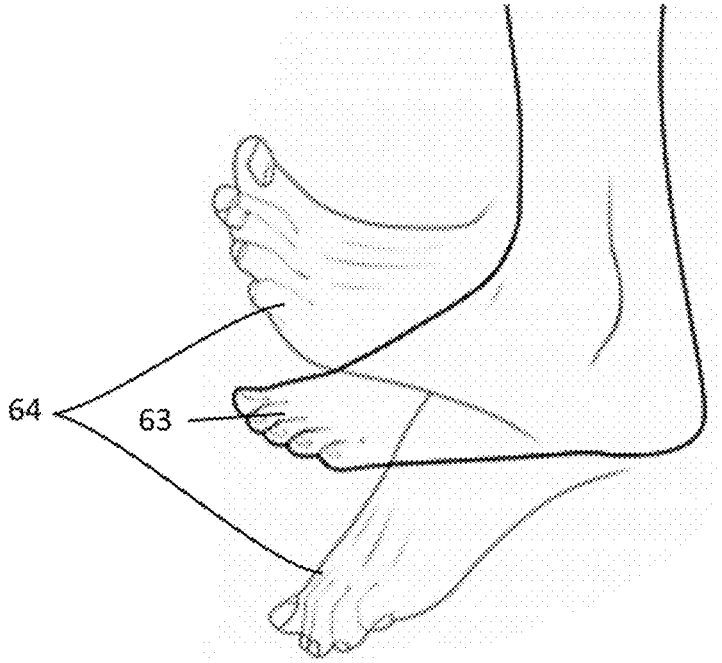

DEVICE FOR IMPLEMENTING A TECHNIQUE OF MENTAL REPRESENTATION FOR REHABILITATION OF LOWER LIMBS

RELATED APPLICATION

This application is a National Phase of PCT/FR2022/051624 filed on Aug. 30, 2022, which claims the benefit of priority from French Patent Application No. 21 10263 filed on Sep. 29, 2021, the entirety of which are incorporated by reference.

TECHNICAL FIELD

The invention relates to the technical field of neuromotor rehabilitation and reeducation equipment.

PRIOR ART

It is known in the state of the art that devices for implementing mental representation techniques for neuromotor rehabilitation and reeducation exist. These techniques are generally based on the activation of visuomotor neurons and can include simulations or visuomotor training, such as mirror therapies, for example. These techniques involve tricking the brain into believing that an impaired limb is healthy through an optical illusion system.

Traditionally, a mirror can be used so that when a patient looks at the reflection of their healthy limb in this mirror, the patient feels as if they are moving their impaired limb. Thus, thanks to the brain's plasticity, the remodeling of neural connections is possible, with beneficial results for addressing chronic pain or motor impairment of the limb. An example of a device for mirror therapy is described in patent GB2436150.

More recently, electronic devices have been developed for mental representation techniques, particularly mirror therapies. These devices include a camera, a screen, and a support system to ensure a proper relative position between the different components of the device and the patient. Thus, the reflection of a limb is replaced by a digitally altered image. Such devices are disclosed, for example, in documents KR101196960 or in the patent EP3692543 by the Applicant.

However, these devices are rather suited for upper limbs only. Some devices can capture images of movements of healthy lower limbs, especially from a bird's-eye view, but the results of therapies conducted with these devices are not entirely satisfactory.

Moreover, the device must be adjusted according to the morphology of each patient, including their build, bearing, posture, and movement possibilities, influenced by their impairments, disability, or even the use of a wheelchair. Due to the relatively long time required to set up the patient at each session, the treatment's effectiveness is reduced.

SUMMARY OF THE INVENTION

One of the goals of the invention is to address the drawbacks of the prior art by proposing a neuromotor rehabilitation and reeducation equipment based on mental representation techniques, which is suitable for lower limbs and provides improved results compared to those of the prior art.

Another goal of the invention is to offer a device that is simple to implement, with easy adjustment.

To this end, a device has been developed for implementing a mental representation technique for the rehabilitation of at least one lower limb, in front of which a patient is intended to be positioned, the device comprising:

- a central camera arranged to film the lower limb from a central point of view;
- a central display screen arranged to block the patient's direct view of the lower limb, intended to display the viewpoint filmed by the central camera.

According to the invention, the device also includes at least one lateral camera arranged to film the lower limb from a lateral perspective, and a lateral display screen intended to display the viewpoint filmed by the lateral camera.

In this way, the central viewpoint, necessary for the patient to internalize the images projected on the central screen, is complemented by a second lateral viewpoint which allows for a better visualization of the movements performed. The full range of movements performed by the lower limb is perceptible, which allows for optimal engagement of the visuomotor neurons, thus making the exercises more effective. Indeed, the movements of the dorsiflexor muscles, which allow for flexing the foot upwards and downwards, and whose mobilization is essential for relearning to walk, are well perceived by the patient.

In a preferred embodiment, the device includes two lateral cameras, positioned on either side of the central camera, and two lateral screens positioned on either side of the central screen. In this way, the device is symmetrical and can film and reproduce images of the patient's right or left lower limb without the need to move equipment, which would waste time.

To easily adapt to the patient's morphology, the central camera as well as the central screen are connected to a structure, and the structure is adjustable in height. This height adjustment also allows for adaptation to a sitting or standing position of the patient.

To improve the ergonomics of the system and the comfort of the patient, the structure includes a shelf, intended to support the patient's upper limbs.

The device includes a control and operating interface, accessible to a practitioner. Thus, the device is complete and autonomous. If it includes a structure mounted on wheels, the complete device can be movable, and quickly set up without losing time to reconnect a new control interface.

Preferably, the wheels are lockable by brakes or retractable in an off-ground position. In this way, the positioning of the device is lockable.

To best align the patient's viewpoint with the display of the central screen, whether the patient is sitting or standing, it is movable in translation relative to the structure along an antero-posterior axis(S) of the patient, preferably also along a transversal axis of the patient, preferably movable along an arc centered on the patient, and even more preferably pivotable around an axis parallel to the transversal axis of the patient. For the patient, this enhances the illusion that the display of the central screen corresponds to their limbs that they are looking at directly.

To limit image distortions and enhance visual immersion, the central screen is curved around an axis parallel to a transversal axis of the patient.

The device may further comprise a platform intended to receive at least one foot of the patient, and preferably the platform is tiltable and/or adjustable in height. This platform allows, among other things, for the device to be versatile and to accommodate patients who can move with or without a wheelchair.

To diversify the possible rehabilitation exercises, the platform includes rehabilitation exercise devices designed to cooperate with the foot placed on the platform, preferably featuring visual effects, such as colored and/or luminous areas, and/or haptic effects, such as a rough surface, checker plate, grooves, and/or movable objects possibly equipped with a magnet intended to attach to a metallic area of the platform.

Still with the aim of versatility between patients and to be able to perform different exercises, the platform is preferably retractable and can be dismantled from the device.

To assist the patient in maintaining a standing position, the device includes a support bar connected to the movable assembly, preferably the support bar is retractable between a folded position, and a deployed position where the bar protrudes from the device. The device can thus be used both in a sitting and standing position.

BRIEF DESCRIPTION OF THE DRAWINGS

FIG. 1 is a perspective view, seen from above, of a first device according to the invention.

FIG. 2 is a side view of a second device according to the invention.

FIG. 3 is a front view of the device.

FIG. 4 is a view of a third device according to the invention, in use.

FIG. 5 is another view of the device in use.

FIG. 6 is a view of a platform of the device.

FIG. 7 is an anatomical diagram.

FIG. 8 is a diagram illustrating a foot viewed from above.

FIG. 9 is a diagram illustrating a foot in dorsiflexion viewed from above.

FIG. 10 is a diagram illustrating the movements of a foot in dorsiflexion and plantarflexion viewed from the side.

DETAILED SPECIFICATION OF THE INVENTION

Referring to FIGS. 1 to 3, the invention is a device intended for visuomotor stimulation, used during lower limb therapies, such as mirror therapies. In the description below, the "lower limb" refers to the thigh and/or leg and/or foot of the patient.

To this end, the device includes a central camera (10) projecting an image onto a central screen (11), as well as at least one lateral camera (20) projecting an image onto a lateral screen (21). The central and lateral cameras (10, 20) and the central and lateral screens (11, 21) are supported by a structure (30) of the device.

This structure (30) advantageously includes a shelf (31) on which the patient can rest their arms during the session, to improve their comfort. Indeed, when a patient requires treatment for a lower limb, there is a significant likelihood that they also suffer from an impairment to an upper limb. This is particularly the case when the patient has suffered a stroke, or suffers from a degenerative disease such as Parkinson's disease or multiple sclerosis. Therefore, there is a need to support the upper limb, and the shelf (31) provides suitable support for the arms. Preferably, the position of the shelf (31) is adjustable to adapt to the patient's morphology. This could involve a translation along an axis parallel to an antero-posterior axis(S) of the patient, or a transversal axis (T) of the patient, or a combination of several translations.

Moreover, this shelf (31) helps to limit the patient's urge to look around the sides of the central screen (11) to check what is really happening with their lower limbs, which would break the therapy's effect.

Preferably, the structure (30) includes a height adjustment system so as to simultaneously adjust the height of the central camera (10), the central screen (11), and the shelf (31). These elements are thus mounted on a mobile assembly (32), which can move vertically relative to a base (33) using any suitable means, such as an electric actuator. The device (1) is therefore easy to adapt to different patient morphologies.

Moreover, the device (1) may include a platform (50), so that patients can rest their feet on said platform (50). The platform (50) is preferably retractable or removable so that the device (1) is versatile. This platform (50) can be used, for example, if a patient is in a wheelchair.

At the bottom, the device (1) is as unobstructed as possible to give the practitioner free access to the lower limbs, to the platform (50) if present, and to any additional devices used during exercises.

For visuomotor stimulation to be as effective as possible, the central screen (11) must give the patient the impression that they are directly looking at their lower limbs, as if there were neither a central camera (10) nor a central screen (11).

To achieve this, the central screen (11) is preferably adjustable in position relative to the mobile assembly (32). Advantageously, the central screen (11) is movable in translation relative to the mobile assembly (32) along the antero-posterior axis(S) of the patient as well as along the transversal axis (T) of the patient, preferably movable along an arc centered on the patient, and even more preferably pivotable around an axis parallel to the transversal axis (T) of the patient. For clarity, the antero-posterior axis(S), the transversal axis (T), and the longitudinal axis (V) of the patient are recalled in the diagram of FIG. 7.

The translation along a transversal axis (T) of the central camera (10) and the central screen (11) is visible in FIG. 3, where these two elements have been moved to the extreme left, respectively in positions (10') and (11').

The ability to adjust the transversal position of the central camera (10), and possibly of the central screen (11) concurrently, is advantageous because it allows for the capture of only the healthy limb. Indeed, the brain's work must be lateralized, so that the healthy part of the brain does not take over the injured part. By filming and then working with only one limb at a time, with only one limb displayed at a time, this lateralization is facilitated, allowing for better targeting of the brain areas to be rehabilitated.

Furthermore, in the specific case of an amputated patient, suffering for example from phantom limb pain, this allows for the capture of only the remaining limb, and not to film the stump. Otherwise, the central screen (11) would subsequently display an inverted image where the patient would see their valid limb being virtually amputated, which could be traumatic.

The lateral screens (21), even if they do not correspond to a direct viewpoint of the patient, allow for a better perception of the movement performed. Referring to FIG. 10, the full range of plantarflexion and dorsiflexion movements is clearly visible, which enhances the stimulation of the visuomotor neurons compared to a top-down viewpoint as illustrated in FIGS. 8 and 9.

Preferably, the device (1) includes two lateral cameras (20) and two lateral screens (21), positioned on each side of the device (1). This way, there is no need to move equipment when switching from treating a left limb to a right limb or vice versa.

Additionally, a lateral screen (21) can be useful when the patient records the movements of their healthy limb at the beginning of the session: they can check if they are performing the gestures correctly.

Having a second lateral screen (21) also saves time when starting the work phase when the recorded movements from the side of the valid limb are then displayed on the side of the pathological limb, as there is no mechanical manipulation to be done.

Referring to FIG. 4, a device (1) in use by a patient (60), with the session being guided by a practitioner (70), is shown. The practitioner (70) has a control and operating interface (40), through which they can control the motors of the device (1), for example, those for height adjustment of the mobile assembly (32) relative to the base (33). They also use this interface (40) to control the recording of the different movements performed with the healthy limb, before displaying the inverted image for the patient to perform their visuomotor stimulation exercises. For this purpose, the interface (40) can be connected to a computer present in the device (1). The interface (40) can include, for example, a touchscreen, or buttons arranged on the structure (30). It is understood that the monitor of the interface (40) is not a screen (11, 21) in the sense of the invention: indeed, the interface monitor is not intended to allow the patient to visualize the limb movements.

A typical visuomotor stimulation session proceeds according to the steps described below.

The first step is the installation of the patient in front of the device (1). The device (1) is adjusted according to the patient's morphology, so that they are comfortable: they should be able to rest their arms on the shelf (31), their feet on the platform (50) if applicable, the central camera (10) is adjusted to frame the healthy limb, and the main screen (11) is positioned so that the display of the lower limbs is aligned with the patient's limbs.

The second step is the capture of movements performed by the healthy limb, and their recording within a computer database of the device (1). The movements are of various types and are performed at the request of the practitioner depending on the muscles to be remobilized or the therapy planned. It is important to perform slow movements and to break down the gestures to make a model that is easier to interpret and follow during the third step.

The third step is the visuomotor stimulation itself. The display of the main screen (11) and the lateral screens (21) is modified to deceive the patient's brain and make it believe that it is the pathological limb performing the recorded movements. In practice, in the context of mirror therapy:

- the display of the central screen (11) is reflected in a horizontal direction (inversion of right and left); and
- the display of the first lateral screen (21) is swapped with the display of the second lateral screen (21), with any necessary reflections according to the arrangements of said screens.

Visuomotor stimulation is therefore a process in several dissociated steps. The capture step is critical given the importance of recording movements that are slow enough and legible by the brain: if the movements are too fast or if their amplitude is small, visuomotor stimulation will not be effective. The lateral screens (21), allowing for a better view of the lower limbs in action, for example, the dorsiflexion and plantarflexion movements of the foot, the device (1) according to the invention allows for improving the effectiveness of the stimulation.

It is also seen in FIG. 4 that the device (1) is autonomous: the structure (30) carries all the electronic elements, so that the device (1) is compact. Advantageously, the base (33) is mounted on wheels so that the device (1) is mobile. This mobility can be used to move the device (1) within a treatment room, for example, to adjust the position of the device (1) to the lighting conditions or to organize the treatments to be performed on a treatment platform comprising different types of devices. This mobility can also be used to adjust the position of the device (1) relative to the patient during the installation step. To then lock the position of the device (1), the wheels are equipped with brakes, or the wheels can be retractable between a position in contact with the ground and allowing mobility of the device (1), and a position off the ground where the device (1) rests directly on the ground. Alternatively, the device (1) includes mobile feet between a high position where they do not touch the ground, leaving the device (1) to rest on the wheels in a mobility position, and a low position where the feet are in contact with the ground and retract the wheels in an off-contact position. Furthermore, the wheels also allow for removing the device (1) at the end of the session, so that the patient can engage their limbs by performing the same exercises in direct vision.

Moreover, the presence of wheels also allows for considering exercises where the patient walks following the device (1). In this case, the device (1) advantageously includes energy storage means, so that it can be used autonomously and without being connected to a power outlet.

In the embodiment illustrated in FIG. 5, the central camera (10) and the central screen (11) are adjusted to reproduce the patient's point of view, who believes they are looking at their own lower limbs and not a display.

In the embodiment illustrated in FIGS. 1 to 3, the central camera (10) is pushed towards the back of the device (1). This arrangement does not allow for creating a display substituting the patient's point of view, nevertheless, the capture performed is focused on the moving parts of the limbs rather than on the thighs, which are generally stationary. Although the patient's point of view is not exactly reproduced, the perception of movements is better, which favors the effectiveness of the therapy. The alignment of the display of the central screen (11) and the patient's limbs allows them to identify the displayed limb as their own.

FIG. 6 illustrates a multifunction platform (50). This platform (50) allows for adjusting the height setting of a receiving surface (51) for the feet.

The platform (50) also facilitates the initiation of movement for the dorsiflexor muscles when it features an inclined receiving surface (51). This inclined surface also allows for compensating a height differential in foot reception by modifying the depth of the platform relative to the patient: the reception height of the foot can be finely adjusted without using mechanical adjustment or motorization. Advantageously, the inclination angle (52) of the receiving surface (51) is between 0 and 20°.

The receiving surface (51) can also feature different devices allowing for diversifying, specifying, or making the motor exercises fun:

- It can involve presenting visual effects, such as colored and/or luminous zones, using a receiving surface (51) equipped with LED lights or a display panel;
- It can involve haptic effects using a receiving surface (51) comprising, for example, rough zones and smooth ones, or even featuring grooves;
- The patient can also move objects placed on the receiving surface (51) with their feet, in which case it can be made of sheet metal or steel to cooperate with magnets placed at the base of said objects.

During rehabilitation, the patient in the phase of relearning to walk may be led to perform exercises in a standing position rather than sitting. For this purpose, the device (1) includes one or more support bars (34) intended to be manually grasped by the patient. These bars (34) can be retractable as shown in FIG. 1: a first bar (34) is in a stored position (34*a*), and a second bar (34) is in a deployed position (34*b*). Instead of being arranged along an antero-posterior axis as in FIG. 1, a bar (34) can be transversal, as shown in a stored position in FIGS. 2 and 3. These bars (34) are thus brought to be deployed towards the front, in the direction of the patient, so that they can grasp them when standing.

For these standing exercises, the position of the central camera (10) towards the back of the device (1) as well as the position of the lateral cameras (20), all with a slightly top-down viewpoint, allow for framing the capture from the feet to the pelvis of the patient. Moreover, the central screen (11) is adjustable along the antero-posterior axis(S) so that its position can be adapted to best match the patient's point of view. In this case, the central screen (11) is moved back as far as possible, in a position far from the patient, thus freeing the support bars (34) that the patient must grasp. The lateral cameras (20) are fixed, so as to always be focused on the patient's feet, whether they are sitting or standing.

Furthermore, the device (1) can be configured differently from the figures without departing from the scope of the invention, which is defined by the claims.

In a variant not shown, the device (1) has only one lateral camera (20) and one lateral screen (21), to save on equipment.

In another variant not shown, the bars (34) are vertical, and are arranged on either side of the device (1).

In another variant not shown, the device (1) includes lighting means to ensure good brightness for image capture. These lighting means are preferably placed under the mobile assembly (32).

It is also possible, using the control interface (40), to select the screens that display or not. For example, the central screen (11) can be always activated, while only one of the lateral screens (21) is turned on, etc. In particular, in the case of patients with hemineglect, only one of the lateral screens (21) is turned on, and preferably its lateral position is far from the patient. In this way, it is possible to force the patient's attention to the side of their hemineglect.

In some cases, the cameras do not capture, and the screens (central and lateral) project previously recorded images. For example, in the case of patients suffering from conditions affecting both lower limbs, and who do not have a healthy limb with which to record movements during the capture phase, visuomotor stimulation is performed using movements recorded by a third party. In this mode, the cameras are not used during the visuomotor stimulation session, but the central and lateral displays produce the desired effect to deceive the brain.

Moreover, the technical characteristics of the different embodiments and variants mentioned above can be, in whole or in part, combined with each other. Thus, the device (1) can be adapted in terms of cost, functionality, and performance.

The invention claimed is:

1. A device for implementing a mental representation technique for the rehabilitation of at least one lower limb, in front of which a patient is intended to be positioned, the device comprising:

a central camera arranged to film the lower limb from a central point of view;

a central display screen arranged to block the patient's direct view of the lower limb, intended to display the viewpoint filmed by the central camera; wherein said device also includes at least one lateral camera arranged to film the lower limb from a lateral perspective, and a lateral display screen intended to display the viewpoint filmed by the lateral camera.

2. The device according to claim 1, wherein the device includes two lateral cameras, positioned on either side of the central camera, and two lateral screens positioned on either side of the central screen.

3. The device according to claim 1, wherein the device the central camera as well as the central screen are connected to a structure, and the structure is adjustable in height.

4. The device according to claim 3, wherein the structure includes a shelf intended to support the patient's upper limbs.

5. The device according to claim 1, wherein the device includes a support bar connected to the mobile assembly, the support bar is retractable between a folded position, and a deployed position where the bar protrudes from the device.

6. The device according to claim 1, wherein the device includes wheels, lockable by brakes or retractable in an off-ground position.

7. The device according to claim 1, wherein the device includes a control and operating interface, accessible to a practitioner.

8. The device according to claim 3, wherein the central screen is movable in translation relative to the structure along an antero-posterior axis of the patient as well as along a transversal axis of the patient, movable along an arc centered on the patient.

9. The device according to claim 1, wherein the central screen is curved around an axis parallel to a transversal axis of the patient.

10. The device according to claim 1, wherein the device further comprises a platform intended to receive at least one foot of the patient, and the platform is tiltable and/or adjustable in height.

11. The device according to claim 10, wherein the platform includes rehabilitation exercise devices designed to cooperate with the foot placed on the platform, featuring visual effects.

12. The device according to claim 10, wherein the platform is retractable and can be dismantled from the device.

13. The device according to claim 8, wherein the central screen is movable in translation relative to the structure along an antero-posterior axis of the patient as well as along a transversal axis of the patient, and is pivotable around an axis parallel to the transversal axis of the patient.

* * * * *